United States Patent [19]

Rhodes

[11] 4,057,071

[45] Nov. 8, 1977

[54] ELECTROSTATIC CHARGE REDUCER

[75] Inventor: Donald F. Rhodes, Pittsburgh, Pa.

[73] Assignee: Gulf Research & Development Company, Pittsburgh, Pa.

[21] Appl. No.: 717,452

[22] Filed: Aug. 24, 1976

Related U.S. Application Data

[63] Continuation-in-part of Ser. No. 431,901, Jan. 9, 1974, abandoned.

[51] Int. Cl.[2] ..... H05F 3/06

[52] U.S. Cl. ..... 137/1; 361/215

[58] Field of Search ..... 137/1, 13; 317/2 R; 324/325, 496

[56] References Cited

U.S. PATENT DOCUMENTS 3,784,876 1/1974 De Gaston ..... 317/2 R

*Primary Examiner*—Alan Cohan

[57] ABSTRACT

The electrostatic charge generated by nonconductive liquids flowing through a pipeline and other apparatus is reduced by exposing the liquid to gamma radiation. In a preferred arrangement, a capsule containing cobalt-60 is suspended in the flowing liquid immediately before the liquid is discharged into a vessel in which it may be in contact with air.

12 Claims, 3 Drawing Figures

ELECTROSTATIC CHARGE REDUCER

This application is a continuation-in-part of my Application Ser. No. 431,901, filed Jan 9, 1974, entitled Electrostatic Charge Reducer now abandoned.

This invention relates to an apparatus and method for reducing the static charge that builds up on nonconductive liquids as they flow through and into pipelines and other apparatus.

As petroleum products and other nonconductive liquids are moved through pipelines from one vessel to another or through apparatus in which there is substantial friction between the petroleum and apparatus, a static charge is developed which may cause a spark that in turn can cause an explosion or fire. The static charge that is generated on petroleum products increases with the velocity of flow of the petroleum products. Another important factor in the generation of a static charge is the surface area of the solid equipment contacted by the liquid. The static charge that is generated on steel or other metallic equipment in which the petroleum products are handled can be relatively quickly dissipated. A satisfactory means for reducing the static charge on the nonconductive liquids has not been available.

It is particularly important that means be available for reducing the static charge that is generated in the handling of jet fuel. The large volume of fuel used by jet planes and the short time available for refueling make high flow rates essential during the loading operation. It is also imperative that the jet fuel be free of contaminants, and for that reason the fuel is filtered immediately before it is delivered into the tanks of a jet plane. The high velocity and the large surface area contacted by the jet fuel in a filter combine to develop substantial electrical charges during the loading of a jet plane as well as during the filling of storage tanks with jet fuels. The absence of contaminants in the jet fuel reduces its conductivity and makes more difficult draining off the electrical charge on that fuel.

One type of apparatus that has been used for reducing the electrostatic charge on petroleum products is described in Erickson et al U.S. Pat. No. 3,616,815. It consists of an electrically insulated passageway through which the petroleum products pass and into which extend a plurality of spaced pins. The pins are connected with suitable grounding means. Apparatus of the type described in U.S. Pat. No. 3,616,815 are very effective for a time after their installation, but their performance deteriorates during use until they become substantially useless. It is believed that the deterioration is caused by the accumulation of residue on the pins that extend into the fuel stream. A similar type of apparatus is disclosed in U.S. Pat. No. 3,160,785 of Munday.

One method of combating the problem of electrostatic charge generated during the transfer of nonconductive liquids is to limit the velocity of the liquid flowing through the pipeline. To avoid limiting the velocity unnecessarily, apparatus has been developed for detecting the charge on the liquids and using the signal derived from the amount of charge to control the rate of delivery of the liquids to prevent generation of an excessive or dangerous static charge. Typical apparatus for such purpose is described in U.S. Pat. No. 3,013,578 of Askevold and U.S. Pat. No. 3,405,722 of Carruthers et al. U.S. Pat. No. 3,164,747 of Yahnke describes apparatus which includes a sensing element for determining the electrostatic charge on the liquid as it is discharged into a storage vessel and using the signal derived from those sensing means to control a charge emitter designed to reduce the electrostatic charge on the liquid. Of course, any system that depends on reducing the rate of delivery of the liquid is objectionable in that it reduces the liquid handling capacity of the system. If the system is for fueling jet aircraft, a reduction in the fueling rate can cause a substantial reduction in the flying time of the aircraft.

U.S. Pat. No. 3,784,876 of DeGaston describes two types of apparatus for reducing the electrostatic charge on electrically nonconductive liquids. In the preferred embodiment, the entire mass of liquid is ionized to render the liquid electrically conductive whereupon the electrostatic charge is drained to ground. In that embodiment, DeGaston provides an enlarged housing connected in series with the delivery line. A grid containing a number of closely spaced, very thin strips containing a beta radiation source such as strontium silicate micro spheres covered with aluminum foil and an outer skin of stainless steel extends across the housing. The extremely large amount of beta radiation source, 9175 curies, required in the DeGaston apparatus makes the cost of the apparatus so high that use of the device is not economically feasible. The large amount of radiation source material and the fragile nature of the strips of radiation source create severe safety problems.

The second embodiment of apparatus described in the DeGaston patent is useful when there is laminar flow of the liquid through the delivery line. In that embodiment, only the thin layer of liquid near the wall of the conduit is ionized. That layer then acquires the induced charge on the conduit. The charged layer mixes with the central mass of liquid at a downstream location whereupon the charge on the liquid is neutralized. As indicated above, the problem of excessive electrostatic charge on nonconducting liquids can be avoided by reducing the flow rate of the liquid. At the high rates of flow at which the electrostatic charge problem is severe, flow through the pipe is turbulent rather than laminar.

This invention resides in an apparatus and method for reducing the electrostatic charge of nonconductive liquids, particularly inflammable liquids such as petroleum products, and especially jet fuel, as the nonconductive liquid is caused to flow at high velocities through pipes and other apparatus for delivery to a tank in which the liquid is exposed to gamma radiation immediately before delivery into the tank. In a preferred embodiment of this invention, a radiation source comprising cobalt-60 is inserted in a U-bend of a pipeline adjacent the fill line for the tank. The section of pipe containing the radiation source is shielded with lead. The pipeline is suitably grounded whereby the charge on the liquid is drained to ground.

Figure 1:
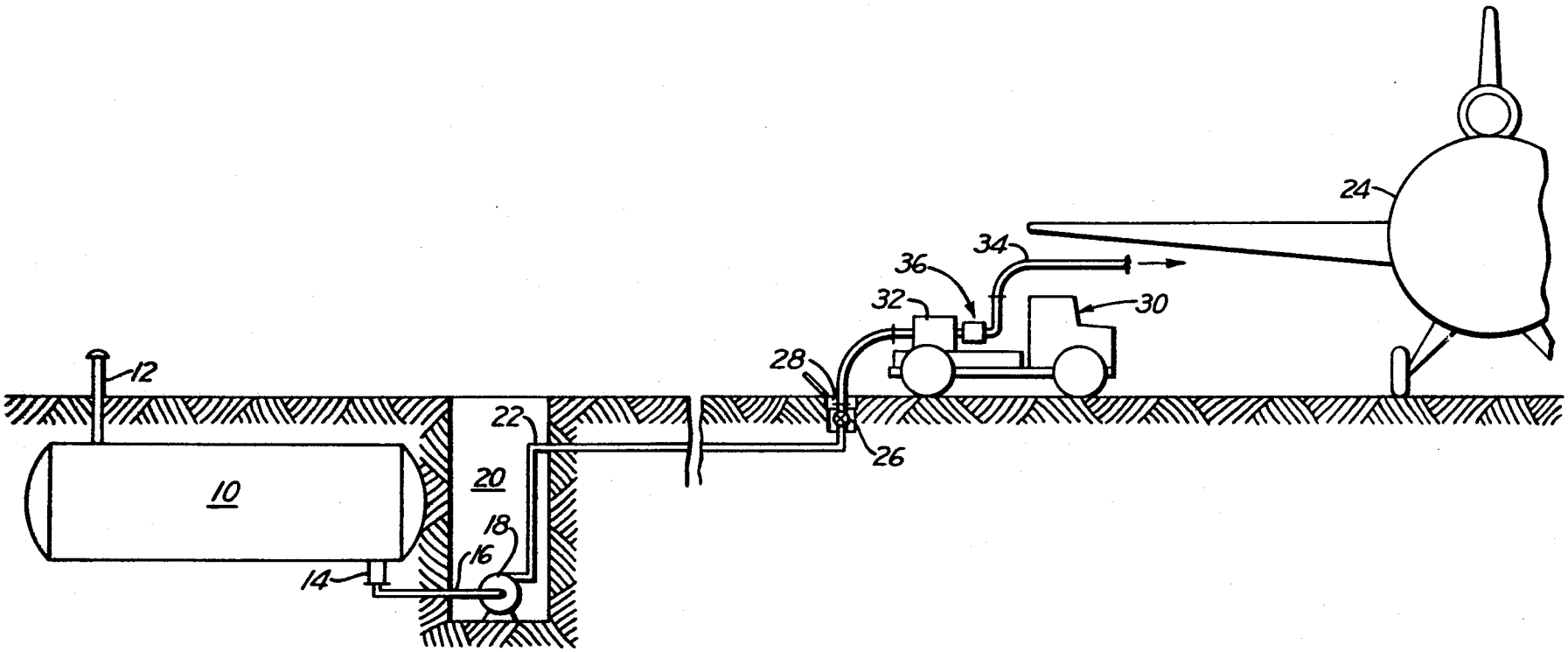
FIG. 1 is a diagrammatic view of typical apparatus for storage of jet fuel at an airport and delivery of the jet fuel into an airplane in which the static charge reducer of this invention is mounted on a hydrant servicer.

Referring to FIG. 1 of the drawings, a jet fuel storage tank 10 having a filling line 12 is located underground. The storage tank 10 is provided with a suitable vent line, not shown, which may be connected to conventional vapor recovery apparatus. Storage tank 10 is provided with a bottom outlet nozzle 14 which is connected to the suction line 16 of a fuel delivery pump 18. In the apparatus shown, fuel delivery pump 18 is mounted in a well 20.

Connected to the outlet of pump 18 is a delivery line 22 which extends underground to a location adjacent the loading and unloading area for a jet plane 24. In accordance with the conventional systems at airports, the end of line 22 remote from pump 18 is connected to a hydrant 26 which may be located underground in a suitable box 28 and is provided with suitable fittings for connection to a hose, control means for operating pump 18, etc.

During servicing of airplane 24, a hydrant servicer indicated generally by reference numeral 30 is connected to the hydrant 26. Hydrant servicer 30 is provided with suitable hose reels, swing joints, pumps, gauges, valves and a flow meter to deliver a controlled volume of fuel from hydrant 26 through a filter 32 on the hydrant servicer and a delivery hose 34 into the fuel tank on the airplane 24. Mounted on the hydrant servicer 30 downstream from filter 32 is the static charge reducer 36 of this invention. Except for the static charge reducer of this invention, hydrant servicers, such as hydrant servicer 30, are known and have been used at airports and are not a part of this invention.

Figure 2:
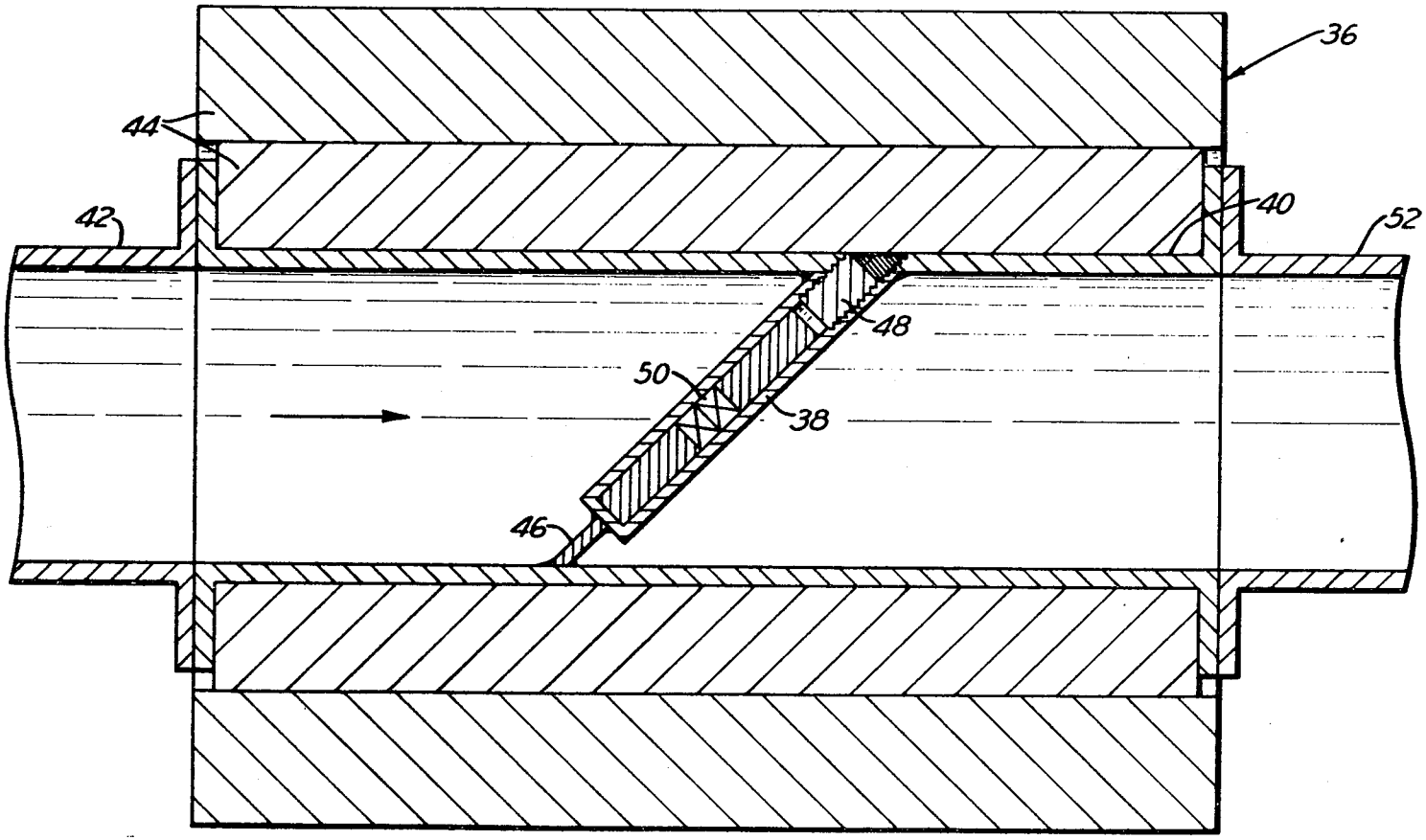
FIG. 2 is a longitudinal sectional view through the section of pipeline in which the static charge reducer is mounted and through the charge reducer.

Referring to FIG. 2 in which the electrostatic charge reducer 36 is shown in a sectional view, a cylinder 38 is mounted in a section 40 of pipe. Section 40 is pipe of substantially the same nominal size as the hydrant 26 and pipes and hoses on the hydrant servicer 30. In the embodiment illustrated in FIG. 2, section 40 of pipe is flanged at one end for connection to the flanged end of a pipe 42 from the outlet of filter 32 and at the other end for connection to a pipe 52 adapted to be connected to the delivery hose 34. Surrounding the section 40 is a lead shield 44.

Cylinder 38, which is preferably constructed of stainless steel and has a wall thickness of approximately one-fourth inch, is closed at its lower end and has a peg 46 extending therefrom and welded to the inner surface of section 40 of pipe to support the cylinder. The upper end of cylinder 38 is open but is internally threaded to receive a plug 48. Cylinder 38 is welded at its upper end to the inner surface of pipe section 40 to form a very rugged and safe container for the radiation source material. Centrally supported within the cylinder 38 is a source 50 of gamma radiation for reducing electrostatic charge on a nonconductive liquid passed through pipe section 40.

The shielding of the radiation source illustrated in FIG. 2 is strictly diagrammatic. It will be necessary to take care to shield the radiation source to avoid stray radiation. The design of the shielding will depend upon the arrangement and location of the charge reducer on the hydrant servicer. To provide complete shielding, for example, pipe 42 connected to the inlet end of pipe section 40 and pipe 52 connected to the outlet of pipe section 40 can be ells and the ells completely shielded with lead. Another possible arrangement for the apparatus of this invention is for the final filter and the charge reducer to be located underground, for example, adjacent hydrant 26, in which event entirely different problems of shielding of the charge reducer would exist.

Figure 3:
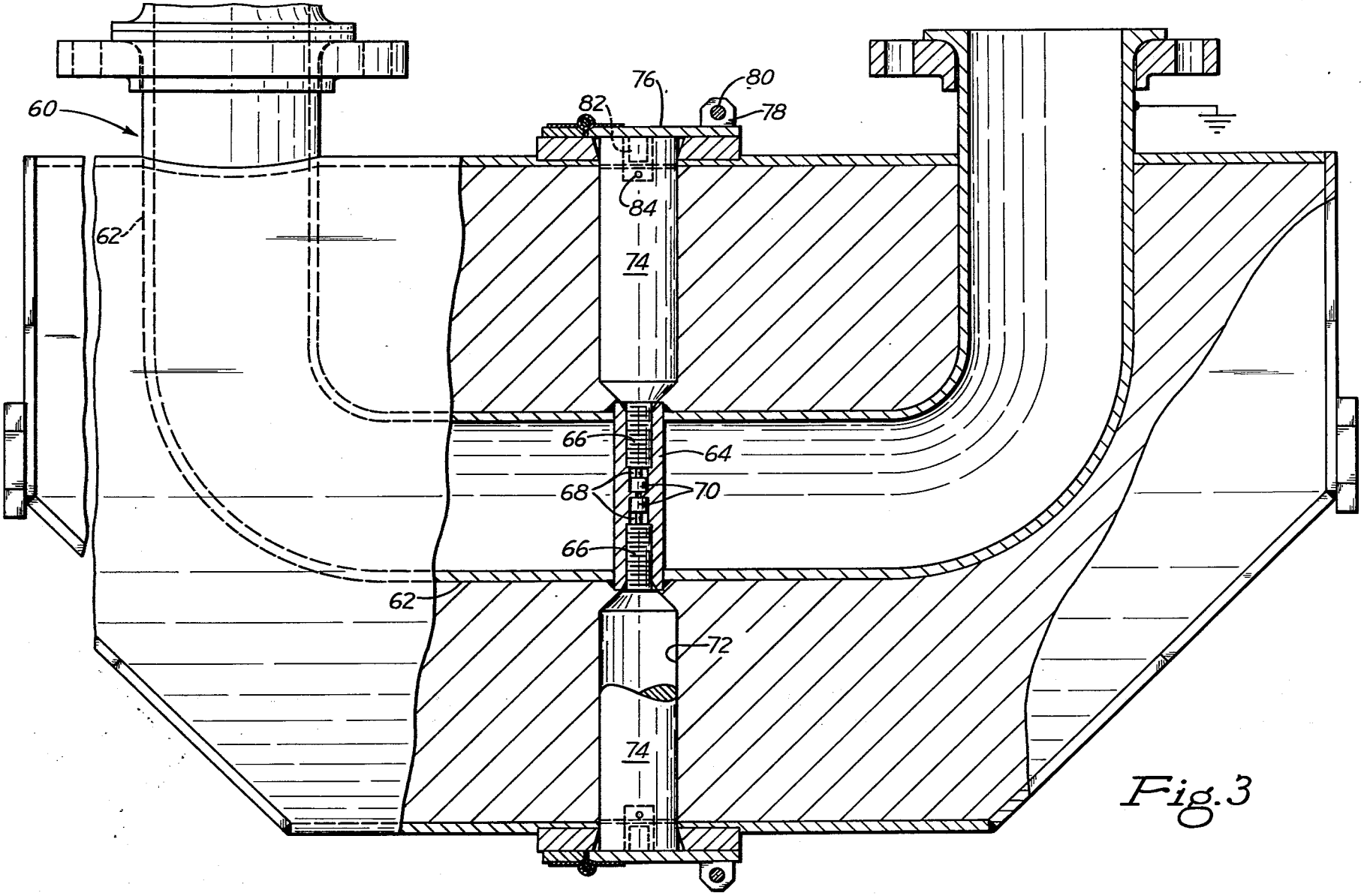
FIG. 3 is a longitudinal sectional view through a preferred embodiment of the static charge reducer.

Referring to FIG. 3 of the drawings, the preferred embodiment of the invention includes a U-bend indicated generally by reference numeral 60 of pipe 62 of essentially the same diameter as delivery lines from the hydrant 26 and in the servicer 30. At large airports the main header from the fuel storage may be 6 to 8 inch pipe with 3 to 4 inch pipe running from the header to the hydrants at the loading stations. U-bend 60 may be constructed of spaced-apart ells welded to pipe joints to form the desired U-shaped structure. In a typical installation, pipe 62 is 4-inch pipe constructed in a manner such that the spacing between the legs of the U is approximately 20 inches.

The U-bend 60 is encased in lead that fills the space between the legs of the U-bend and extends outwardly beyond the legs for a distance of approximately 5 inches. The lead is covered with steel plates to provide a suitable base for attaching supports from the servicer 30, closure plates, etc. In the base of U-bend 60 pipe 62 is drilled at the ends of the diameter to receive a cylinder 64 which extends outwardly beyond the walls of the pipe and is welded thereto. Cylinder 64 consists of a rod, for example, 1 inch in diameter, which is drilled at both ends to form sockets that are threaded to receive set screws 66. The drilling extends inwardly at a reduced diameter from the end of each of the sockets for the set screws to form chambers 68 to receive source material indicated by the reference numeral 70. Each of the chambers 68 contains 100 curies of Co-60 as the source material 70. The chambers 68 are approximately one-fourth inch in diameter and three-fourth inch long to leave a wall thickness of the cylinder surrounding the source material slightly over one-fourth inch.

Sockets 72 are drilled inwardly through the plates and lead surrounding the pipe 62 in alignment with the axis of the cylinder 64. A lead plug 74 is inserted in each of the sockets. The lead plugs are held in place in the sockets by hinged plates 76 mounted on the steel cover. A tongue extends from the plates 76 between the legs of clevis 78 and is held in place by pins 80. Each of lead plugs 74 is centrally drilled at its outer end to receive a threaded thimble 82, held in place in the plugs by rods 84, to provide means for removing the plugs.

In the operation of the apparatus shown in the drawings, the hydrant servicer 30 is connected to the hydrant 26 and the delivery hose 34 connected to the fill nozzle of the fuel tanks on the airplane 24. Pump 18 is started from remote control at the hydrant 26 and the fuel delivered through the filter 32 and charge reducer 36 into the fuel tank of airplane 24. Gamma radiation from the radiation source 50 or 70 reduces the electrostatic charge on the jet fuel flowing through pipe section 40 to a level at which danger of sparking and, consequently, of igniting fuel-laden vapors in the fuel tanks of airplane 24 is nil.

In a test of the operability of the static charge reducer constructed in accordance with this invention, a jet fuel was pumped through a pipeline from a storage tank to a transport tank. A pump was connected in the pipeline between the storage tank and the transport tank and a pair of filters were connected in parallel between the pump and the transport tank. A radiation source was installed in the pipeline between the filters and the transport tank and a static charge sensor was installed in the pipeline between the radiation source and the transport tank. The radiation source used in the test work was 1277 curies of cesium-137 in stainless steel capsules. Because of the inefficiency of the structure used in the test work for transmitting the radiation into the jet fuel, the source of radiation was substantially larger than would be required in a well-designed system.

During the testing process the objective was to obtain a series of measurements of the reduced charge density as a function of total radiation dose. The radiation dose was varied by adjusting the linear velocity of the stream thus controlling the exposure time in the radiation cell. In addition, the charge density was varied during the test by adjusting the stream velocities through the filters. The jet fuel was pumped from the storage tank through the filter and other associated equipment and into the trailer transport. When the transport was nearly filled, the test was stopped and the fuel pumped back into the storage tank. During each test run the jet fuel stream was pumped at a constant flow rate which was monitored on a chart recorder. During each run a stabilized measurement of the static charge density was made both with and without the application of ionizing radiation. The charge density measurement was made at a point just before fuel entered the transport. By carrying out the test in this way, possible relaxation time errors were eliminated.

The results of the measurements of static charge on the jet fuel transported and the reduction of the static charge by the gamma radiation are set forth in the following table:

TABLE I

| Flow Rate (GPM) | Measurements of Static Charge Reduction in Jet Fuel: Charge Density ($\mu c/m^3$) No Radiation | Charge Density ($\mu c/m^3$) Radiation Applied | Radiation Dose (Rads) | Percent Charge Remaining |
|---|---|---|---|---|
| 250 | 158 | 96 | 0.21 | 61 |
| 250 | 13 | 7.9 | 0.21 | 61 |
| 200 | 141 | 88 | 0.26 | 62 |
| 150 | 220 | 88 | 0.35 | 40 |
| 150 | 202 | 106 | 0.35 | 53 |
| 100 | 176 | 70 | 0.53 | 40 |
| 100 | 114 | 53 | 0.53 | 47 |
| 100 | 106 | 53 | 0.53 | 50 |
| 100 | 35 | 18 | 0.53 | 51 |
| 75 | 158 | 53 | 0.69 | 34 |
| 75 | 97 | 35 | 0.69 | 36 |
| 75 | 53 | 26 | 0.69 | 49 |
| 50 | 97 | 26 | 1.0 | 27 |
| 50 | 26 | 7 | 1.0 | 27 |
| 25 | 62 | 0 | 2.1 | 0 |

Although the tendency for spark formation is dependent upon the static charge on the liquid, other factors also influence the tendency to spark and the tendency to spark is not a simple direct proportion to the magnitude of the electrostatic charge. As a general rule, sparking can be avoided if the static charge on the liquid is reduced to 10 percent or less of the static charge generated by the liquid flowing through apparatus. To accomplish that static charge reduction, a minimum gamma radiation dose of about 1.75 Rads (i.e., 175 ergs/gm) should be given the jet fuel.

Cesium-137 is one source of gamma radiation that can be used in the static charge reducer of this invention. It has the advantage of a long half-life and a low gamma-ray energy which reduces the amount of shielding required. Another radiation source that can be used is cobalt-60 and that source has the advantage of a lower cost than cesium-137 and the ability to provide a dose rate per curie of radiation source approximately four times the dose rate that can be obtained with cesium-137. In a commercial device of the type illustrated in FIG. 3 of the drawings adapted to reduce the static charge on jet fuel pumped at a rate of 600 gallons per minute through a conventional airport loading system and hydraulic servicer, a radiation source of 200 curies of cobalt-60 is adequate to accomplish the desired static charge reduction.

In the description of this invention, there are repeated references to the liquid being nonconducting or nonconductive. Those terms are used to designate liquids having a conductivity low enough that an electrostatic charge high enough to cause sparking can be developed by pumping the liquid through a pipeline. The term "fuel tank" is used to designate any vessel into which a combustible, nonconducting liquid is delivered and may be a storage tank, supply tank, or delivery tank.

The electrostatic charge reducer of this invention provides a compact low cost structure that may be installed on a mobile hydrant servicer and that is highly effective in ionizing the nonconductive liquid and rendering it conductive whereby the electrostatic charge is quickly drained to ground. The thick wall, at least one-eighth inch and preferably one-fourth inch or more in thickness, of the cylinder in which the gamma radiation source is supported provides a rugged structure in which there is no danger of radiation source material being broken loose and carried downstream in the liquid flowing through the pipe at very high velocities ranging up to as high as 1000 feet per minute. Beta radiation has a half value thickness in steel of approximately 0.03 inch; consequently, any steel container for a beta source is necessarily very thin and fragile. Further safety is derived from the small amount of gamma radiation source material, relative to the amount used in the device described in U.S. Pat. No. 3,784,876 and the ease with which the gamma radiation source can be removed from the cylinder. Moreover, the cost of the source material used in the embodiment of the invention illustrated in FIG. 3 is only of the order of 0.5 percent of the cost of the beta radiation source material in the decharger heretofore available.

I claim:

1. Apparatus for reducing electrostatic charge on a nonconductive and flammable liquid flowing through pipe for delivery into a tank comprising a metallic cylinder secured to the pipe and extending through the wall of the pipe into the opening through the pipe, said cylinder having a wall thickness of at least 1/8 inch, a source of gamma radiation in the cylinder positioned in the opening through the pipe, the quantity of source of gamma radiation being adequate to impart a dose of gamma radiation of at least 1.75 Rads to the liquid flowing through the pipe, and a lead shield around the pipe adjacent the cylinder shielding the space surrounding the pipe from gamma radiation.

2. Apparatus as set forth in claim 1 in which the pipe is of steel and the cylinder is of stainless steel.

3. Apparatus as set forth in claim 2 in which the cylinder extends through an opening in the wall of the pipe and is welded around its periphery to the wall of the pipe.

4. Apparatus as set forth in claim 1 characterized by a U-bend in the pipe, the cylinder extending across the opening in the base of the U-bend of the pipe, and the lead shield being around the U-bend.

5. Apparatus as set forth in claim 4 characterized by diametrically opposed openings in the base of the U-bend, the cylinder extending through the openings and across the opening in the pipe, and welds closing the openings around the cylinder and holding the cylinder in place.

6. Apparatus as set forth in claim 1 characterized by a removable insert in an end of the cylinder extending through the wall of the pipe adapted to close the end of the cylinder and maintain the radiator source in the central portion of the pipe.

7. Apparatus as set forth in claim 5 characterized by removable inserts in each end of the cylinder adapted to close the end of the cylinder and maintain the radiation source in the central portion of the pipe.

8. Apparatus as set forth in claim 5 characterized by sockets in the lead shield communicating with and in alignment with the cylinder, lead plugs removably mounted in the sockets, and means for holding the lead plugs in the sockets.

9. Apparatus as set forth in claim 4 for decharging up to 600 gallons per minute of jet fuel in which the pipe has a diameter of 3 to 4 inches, the cylinder has a wall thickness of approximately one-fourth inch, and 200 curies of gamma-radiation source are in the cylinder.

10. Apparatus as set forth in claim 1 in which the gamma-radiation source is cobalt-60.

11. Apparatus as set forth in claim 1 in which the gamma-radiation source is cesium-137 and cobalt-60.

12. In a system for delivering jet fuel to an airplane in which jet fuel is delivered through pipe to a hydrant at a loading area, a mobile hydrant servicer is connected to the hydrant for delivery of the jet fuel through a filter mounted on the hydrant servicer to a loading line for delivery into the airplane, apparatus mounted on the mobile hydrant servicer between the outlet of the filter and the loading line for reducing the electrostatic charge on the jet fuel delivered to the airplane, comprising a U-bend in pipe substantially the same diameter as the filter outlet, a metallic cylinder having a wall thickness of at least 1/8 inch extending through substantially diametrically opposed openings in the base of the U-bend secured and sealed to the base of the U-bend, a radiation source mounted in the cylinder, removable means closing at least one end of the cylinder to hold the radiation source in place in the cylinder, and lead enclosing the base of the U-bend and the lower end of the legs of the U-bend upwardly at least a portion of their length to shield the space surrounding the apparatus from gamma radiation.

* * * * *